US007134362B1

(12) United States Patent
March et al.

(10) Patent No.: US 7,134,362 B1
(45) Date of Patent: Nov. 14, 2006

(54) BOTTLE CAP OPENER

(76) Inventors: Michael March, Flat 12B, La Clare Mansion, 92 Pokfulam Road, Hong Kong (HK); Shu Wing Charles Ip, C-10 Craigmount, 34 Stubbs Road, Hong Kong (HK)

( * ) Notice: Subject to any disclaimer, the term of this patent is extended or adjusted under 35 U.S.C. 154(b) by 11 days.

(21) Appl. No.: 11/117,565

(22) Filed: Apr. 29, 2005

(51) Int. Cl.
*B67B 7/00* (2006.01)

(52) U.S. Cl. ..... 81/3.4; 81/3.29

(58) Field of Classification Search ..... 81/3.4, 81/3.07, 3.08, 3.29, 3.36
See application file for complete search history.

(56) References Cited

U.S. PATENT DOCUMENTS

| | | | | |
|---|---|---|---|---|
| 2,589,693 | A * | 3/1952 | Hess | 81/3.4 |
| 2,641,943 | A * | 6/1953 | Krize, Jr. | 81/3.4 |
| 3,600,982 | A * | 8/1971 | Tholen | 81/3.4 |
| 4,414,866 | A | 11/1983 | Kichijyo | |
| 4,442,735 | A | 4/1984 | Chance et al. | |
| 4,527,450 | A | 7/1985 | Drosky | |
| 4,590,821 | A | 5/1986 | Olson | |
| 4,887,497 | A | 12/1989 | Daviddi | |
| 5,042,331 | A * | 8/1991 | Allen | 81/3.4 |
| 5,507,210 | A | 4/1996 | Paramest | |
| 2001/0013500 | A1 | 8/2001 | Gilley et al. | |

FOREIGN PATENT DOCUMENTS

DE 38 38 237 A1 5/1990

OTHER PUBLICATIONS

Mechanical Option (Jul. 1996), Champagne Bottle Cork Puller and Inserting Apparatus, pp. 1-5.

* cited by examiner

*Primary Examiner*—David B. Thomas
(74) *Attorney, Agent, or Firm*—Birch, Stewart, Kolasch & Birch, LLP

(57) ABSTRACT

A bottle cap opener for opening twistable type caps. The opener may include a housing to apply a twisting force to the caps. Twisting force may also be applied via a handle. The opener also may include cap grabbers movable within the housing. The progressively narrowing interior shape of the housing allows the cap grabbers to adjust to the size of the cap. The opener also may include engaging members that engage the cap grabbers at a particular position within the housing. The engagement can be accomplished with a set of teeth on the cap grabbers and a corresponding hook member on the engaging members. The engaging members are pivotally mounted and include engaging spring to provide the engaging forces. A spring exerts a downward on the cap grabbers. The bottle opener retains the bottle cap in the housing after the bottle is opened until the user disengages the engaging members.

27 Claims, 8 Drawing Sheets

BOTTLE CAP OPENER

FIELD OF THE INVENTION

This invention relates generally to bottle openers. More particularly, the invention relates to bottle openers capable of opening bottles with twistable bottle caps.

BACKGROUND OF THE INVENTION

Traditionally, wine bottles have been sealed with natural corks. Unfortunately, due to the nature of the corked bottles and the increasing scarcity of high quality corks, a certain percentage of wines, approximately 5%, become spoiled or "corked" due to unwanted exposure to air since the wine cannot be kept air tight. The wine spoilage is becoming a significant issue in the wine industry.

To address this issue, the wine industry has increasingly turned to non-traditional methods to bottle wines. These include artificial corks and twistable bottle caps, typically made from aluminum. For example, the Selvyn brand cap, manufactured by Pechiney of France, is currently the market leader. The adoption of Selvyn cap and similar wine bottle closures has been slow to occur principally due to aesthetic reasons. Namely, there is a view that the twistable wine cap degrades the wine enthusiast's overall experience.

In addition to their new application as wine closures, twistable bottle caps have long been used to seal soft drinks, including pop or soda such as Coca Cola™ or Pepsi™, and are starting to be used with certain brands of beer, wine coolers and other alcoholic beverages. These twistable caps may also be made from metal such as aluminum.

While there is little to no issue with such beverages of manufacturer's or consumers' acceptance, there is a segment of the population who, because of infirmities such as arthritis, Parkinson's disease or other maladies that affect manual dexterity, may have difficulty removing such twistable caps.

SUMMARY OF THE INVENTION

In an aspect of the present invention, a bottle opener may include a conical housing; a plurality of cap grabbers vertically movable within the conical housing for applying a grabbing force to a bottle cap; a spring for exerting a downward force to the plurality of cap grabbers; and a plurality of engaging members for engaging the corresponding plurality of cap grabbers to maintain the cap grabbers in a particular vertical position within the conical housing to allow a twisting force applied via the handle to be transferred to the bottle cap.

In another aspect of the present invention a bottle opener may include a housing with an opening at a bottom; a plurality of cap grabbers movable within the housing for applying a grabbing force to a bottle cap; and a plurality of engaging members for engaging the corresponding plurality of cap grabbers to maintain the cap grabbers in a particular vertical position within the conical housing to allow a twisting force applied via the handle to be transferred to the bottle cap.

BRIEF DESCRIPTION OF THE DRAWINGS

Features and advantages of the invention will become apparent to those skilled in the art from the following description with reference to the drawings, in which:

FIGS. 1D-1 and 1D-2 illustrate examples of two-dimensional perspectives of the shape of the bottle opener housing's interior according to an embodiment of the present invention;

FIGS. 1E-1 and 1E-2 illustrate examples of the housing's exterior shape according to an embodiment of the present invention;

DETAILED DESCRIPTION

For simplicity and illustrative purposes, the principles of the invention are described by referring mainly to exemplary embodiments thereof. However, one of ordinary skill in the art would readily recognize that the similar principles are applicable to types of bottle openers not specifically described herewith.

Figure 1B:
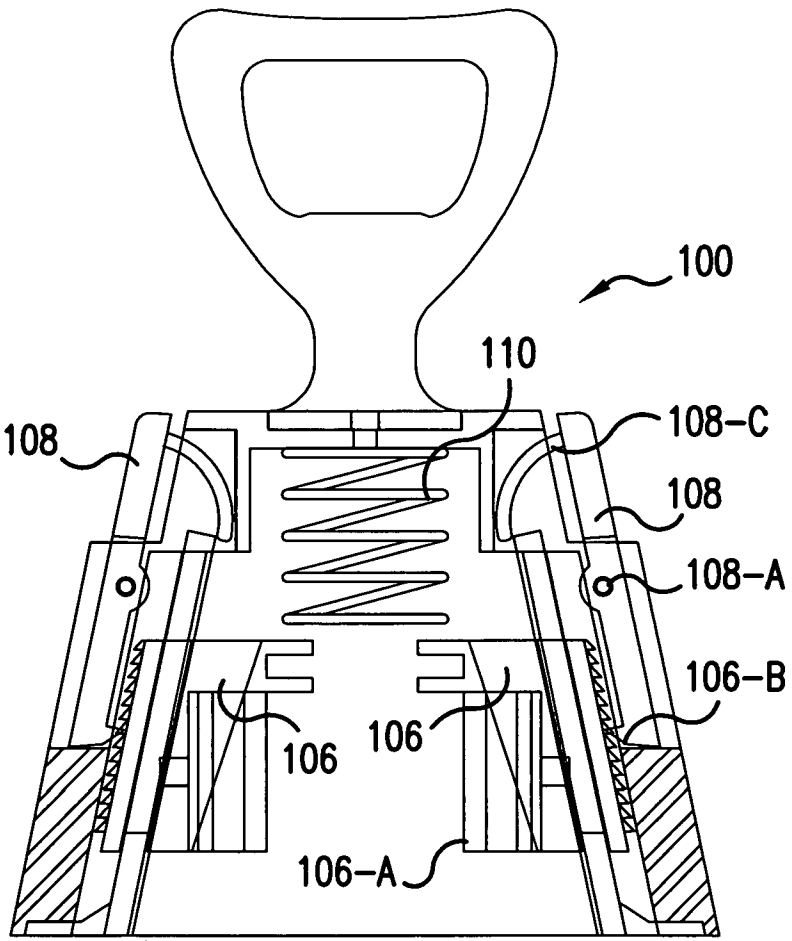
FIG. 1B illustrates an interior view of the bottle opener according to an embodiment of the present invention.
Figure 1A:
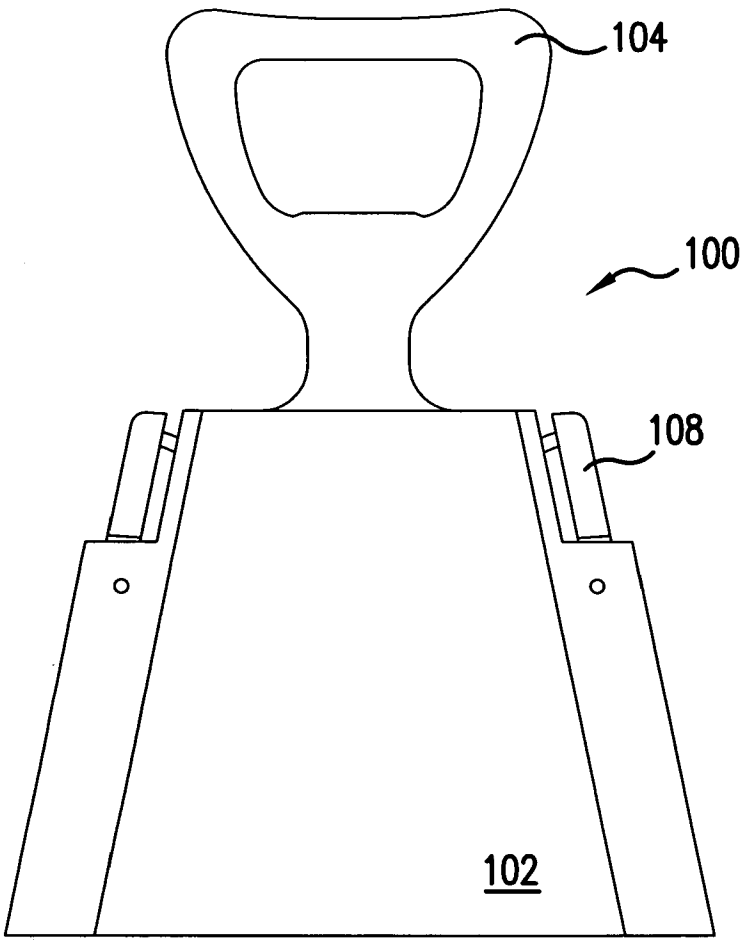
FIG. 1A illustrates an exterior view of a bottle opener according to an embodiment of the present invention.

FIGS. 1A and 1B illustrate an exterior and an interior view of a bottle opener 100 according to an embodiment of the present invention. The bottle opener 100 may include a housing 102, a plurality of cap grabbers 106 within the housing, a spring 110, and a plurality of engaging members 108.

The number of cap grabbers 106 and the engaging members may correspond. For simplicity of explanation, the number of cap grabbers 106 is two and the number of engaging members is correspondingly two as well in FIGS. 1A and 1B. However, the invention is not so limited and the number of grabbers 106 and engaging members 108 may be more than two. Preferably, the physical distribution of the grabbers 106 around the housing 102 and corresponding engaging members 108 is such that they are substantially evenly spaced apart, i.e. substantially equal angles apart. In FIGS. 1A and 1B, the two cap grabbers 106 are substantially directly opposite of each other (180 degrees).

Figures 1, 1C:
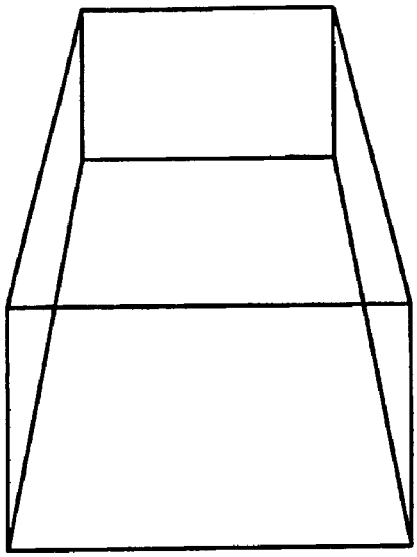
FIGS. 1C-1 and 1C-2 illustrate examples of three-dimensional perspectives of the shape of the bottle opener housing's interior according to an embodiment of the present invention.
Figures 1, 1C, 2:
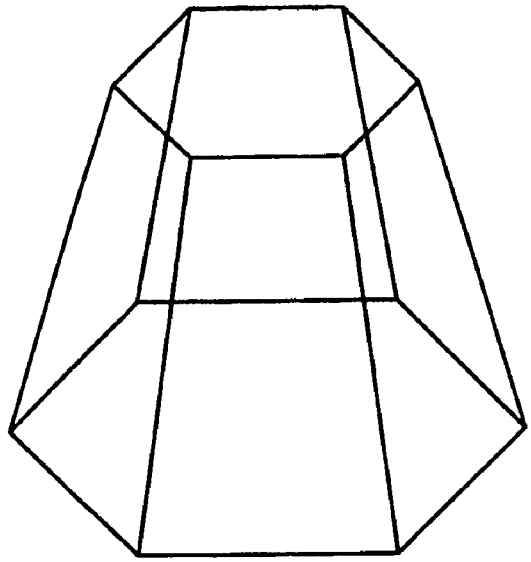

The housing 102 may have an opening at a bottom thereof and an interior of the housing 102 may be shaped to be progressively narrower from the bottom to the top. In FIG. 1B, the interior of the housing 102 is conically shaped. However, the interior shape of the housing 102 is not so limited. As illustrated in FIGS. 1C-1 and 1C-2, three-dimensional perspectives of a four-sided and six-sided pyramid-like shapes are illustrated that progressively narrows from bottom to top. It should be noted that the shapes can include any number of sides.

Figures 1, 1D:
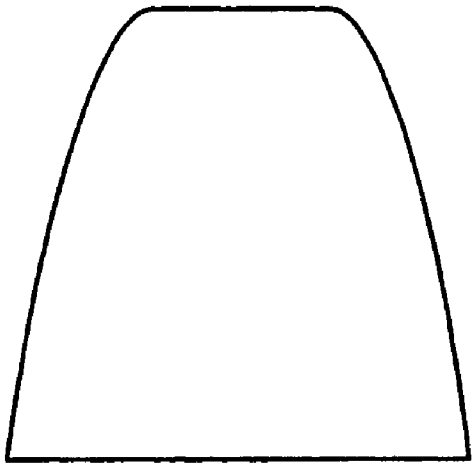
Figures 1, 1D, 2:
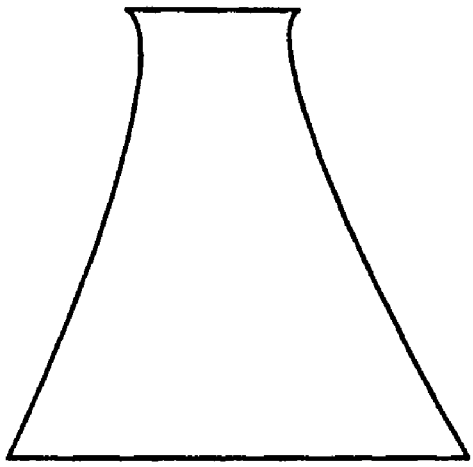

Further, it is not necessary that the progressive narrowing of the housing's interior be strictly linear. FIGS. 1D-1 and 1D-2 illustrate two-dimensional (side) perspectives of example interior shapes of housing 102. As illustrated, the shape can be generally concave or generally convex.

Figures 1, 1E:
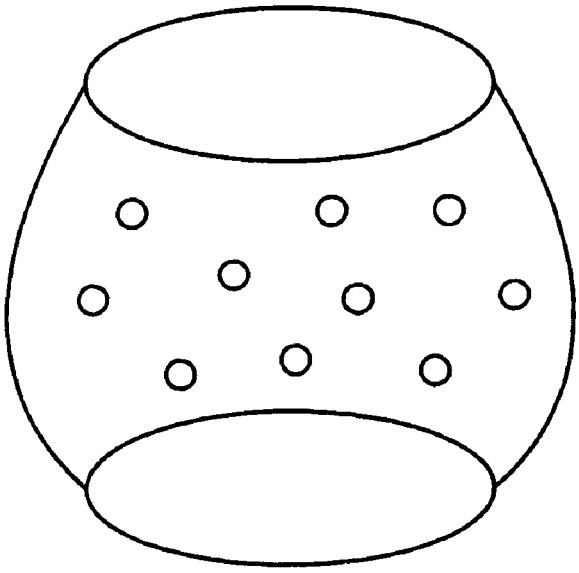
Figures 1, 1E, 2:
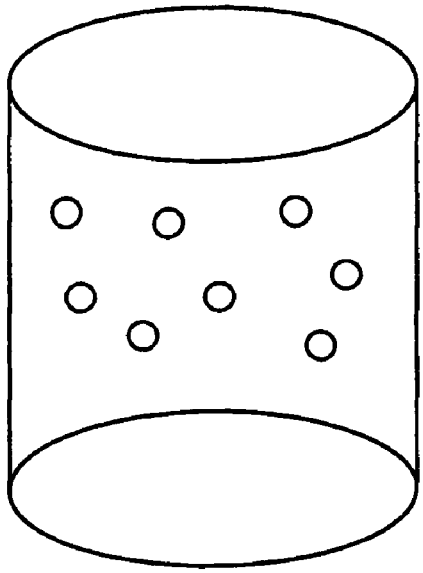

In FIGS. 1A and 1B, a shape of the exterior of the housing 102 may follow the shape of the interior, conical in this instance. However, the shape of the exterior is not so limited and may take on any shape. The shape may be primarily for aesthetic or decorative purposes or can be for functional purposes as well. Examples of the exterior's shape are illustrated in FIGS. 1E-1 and 1E-2. For example, the exterior may take on a shape of a ball or a cylinder. The exterior may be textured, dimples for example, for easy grasping. Also the exterior may be formed of rubber or other soft material to make grasping easier.

A user may apply a rotational/twisting force through rotating the housing 102. This may be done directly by grasping the exterior of the housing 102 to rotate the bottle opener 100 and thereby apply a twisting force. However, the bottle opener 100 may also include a handle 104. For example, a handle 104 may be formed on top of the bottle opener 100 as illustrated in FIGS. 1A and 1B. The user may apply the twisting force via the handle 104. The handle 104 may be formed integrally with the housing 102 or may be formed separately and attached to the housing 102.

As shown in FIG. 1B, the plurality of cap grabbers 106 in the housing 102 may move vertically or substantially vertically within the interior. Due to the progressively narrowing of the interior, as the cap grabbers 106 move up vertically within the interior of the housing 102, the distance between the cap grabbers 106 narrow. This narrowing allows the cap grabbers 106 to adjust to any size cap to apply a grabbing force to the bottle cap.

Figure 2A:
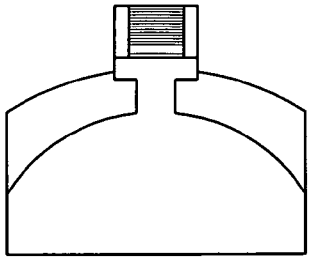
FIGS. 2A–2E illustrate details of a cap grabber according to an embodiment of the present invention.
Figure 2B:
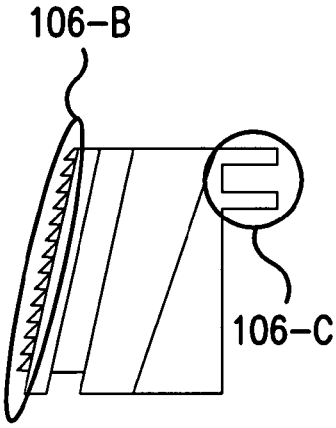
Figure 2C:
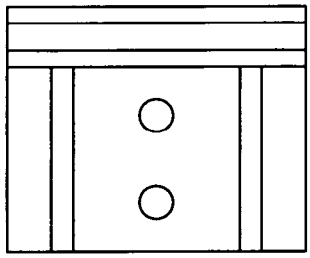
Figure 2D:
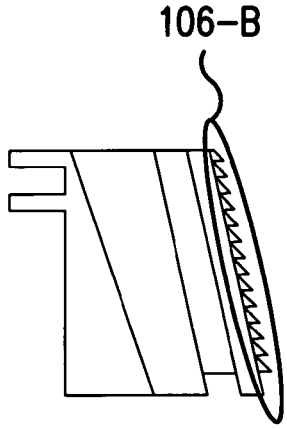
Figure 2E:
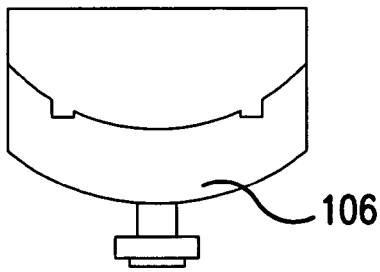

FIGS. 2A–2E illustrate details of a cap grabber according to an embodiment of the present invention. Inner portions of the plurality of cap grabbers 106—the portions that make physical contact with the bottle cap—can be of any shape. However, it is preferred that inner portions be arc shaped as shown in FIG. 2E. The arc shape allows more surface area of the cap grabber 106 to be in physical contact with the bottle and thereby enhance the grabbing property of the cap grabber 106.

Figure 3A:
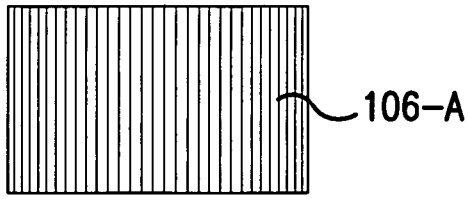
FIGS. 3A–3E illustrate details of a grip according to an embodiment of the present invention.
Figure 3B:
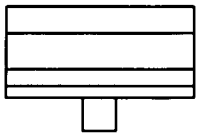
Figure 3C:
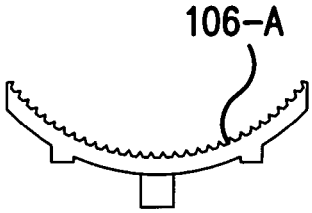
Figure 3D:
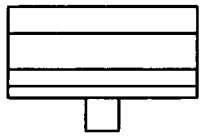
Figure 3E:
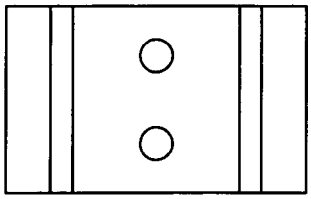

To further enhance the grabbing property, the inner portions each cap grabber 106 may be fitted with a grip 106-A as shown in FIG. 1B. As illustrated in FIG. 3A, the grip 106-A may be shaped to fit the inner portion of the cap grabber 106. Also, the grip 106-A itself may enhance the overall grabbing ability. For example, the grip 106-A may be made from rubber or other such malleable material so that the portion of the grip 106-A in contact with the bottle cap may conform to the shape of the bottle cap to maximize the contact area. In addition, the grip 106-A may include grooves. It is generally preferred that the grooves be formed substantially vertically, i.e. perpendicular to the direction of rotation, to thereby maximize the grabbing ability.

The outer portion of the cap grabber 106 may include a set of teeth 106-B as illustrated in FIGS. 1B, 2B and 2D. The set of teeth 106-B enables each cap grabber to engage with a corresponding engaging member (more on this below). The teeth 106-B may be substantially horizontally grooved, i.e. substantially perpendicular to the movable direction of the cap grabbers 106. By forming grooves perpendicular to the direction of movement, maximum engaging force may be maintained.

At a top portion of each cap grabber 106, a disk gap 106-C may be formed. As shown in FIGS. 1B, 2B and 2D, the disk gap 106-C appears as a notch formed inward in the upper inner portion of the cap grabber 106. Within the disk gaps 106-C of the plurality of the cap grabbers 106, a disk 112 may be fitted. FIGS. 5A–5E illustrate examples of disks 112 according to an embodiment of the present invention. The disk 112 may be fitted such that it is slideable within the disk gap 106-C of all cap grabbers 106. An alternative is to fixedly attach the disk 112 to one cap grabber 106 and be slideable with respect to all other cap grabbers 106.

Figure 5A:
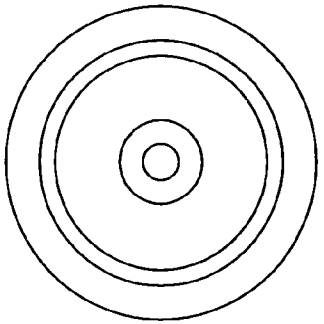
FIGS. 5A–5G illustrate details of disks and spring according to an embodiment of the present invention.
Figure 5C:
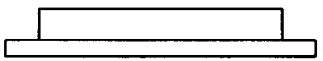
Figure 5E:
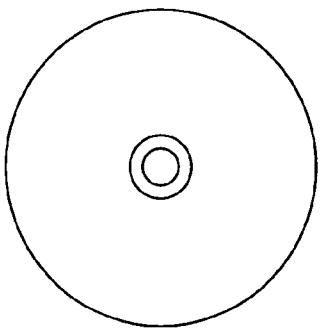
Figure 5B:
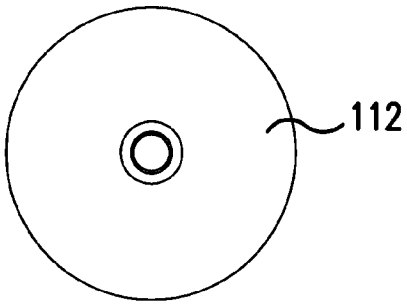
Figure 5D:
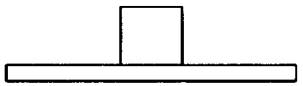
Figure 5F:
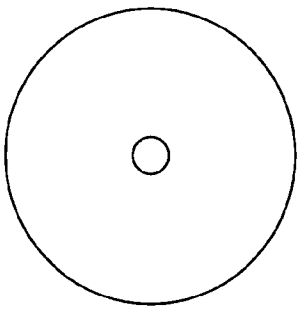
Figure 5G:
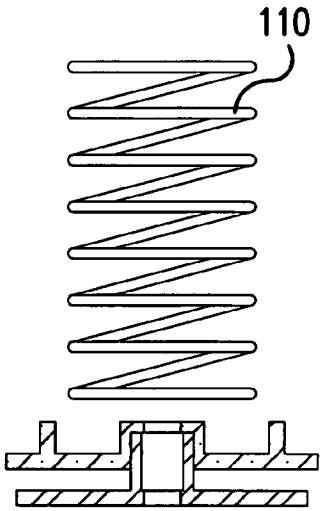

The disk 112 enables the spring 110 to apply a downward force to the plurality of cap grabbers 106 as the spring 110 (see FIG. 5G) is compressed. As shown in FIG. 1B, when the plurality of cap grabbers 106 are moved upwards within the housing 102, the disk 112 (not shown in FIG. 1B) also moves upward within the housing 102. As the plurality of cap grabbers 106 move upward, the spring 110 compresses and applies the downward force on the plurality of the cap grabbers 106. The disk 112 helps to prevent the cap grabbers 106 from bending inward to optimize the downward force of the sprint 110 to the cap grabbers 106. The downward force of the spring 110 returns the plurality of cap grabbers 106 to the bottom of the housing position when the plurality of cap grabbers 106 are released from engaging the plurality of engaging members 108.

As shown in FIGS. 5A–5F, the disk 112 may be circularly shaped. However, the shape of the disk 112 is not so limited. It may take on any shape. It is only necessary that the disk 112 enable a transfer the force of the spring 110 to the plurality of cap grabbers 106.

The bottle opener 100 may also include a plurality of engaging members 108 (see FIGS. 1A, 1B and 4A–4E). Each engaging member 108 may correspond with each of the plurality of cap grabbers 106 as noted above. The engaging member 108 may engage the corresponding cap grabber 106 to maintain the cap grabber 106 in a particular vertical position within the housing 102. When the plurality of cap grabbers 106 are maintained in the particular vertical position, the grabbing force on the bottle cap is maintained as well. This allows the twisting force applied via the housing to be transferred to the bottle cap without continuous manual downward applied by the user.

Figure 4A:
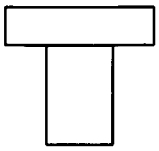
FIGS. 4A–4E illustrate details of an engaging member according to an embodiment of the present invention.
Figure 4B:
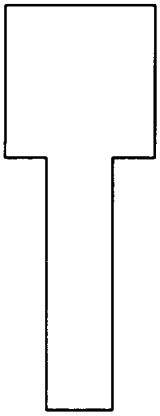
Figure 4C:
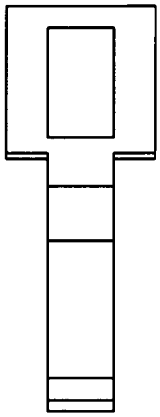
Figure 4D:
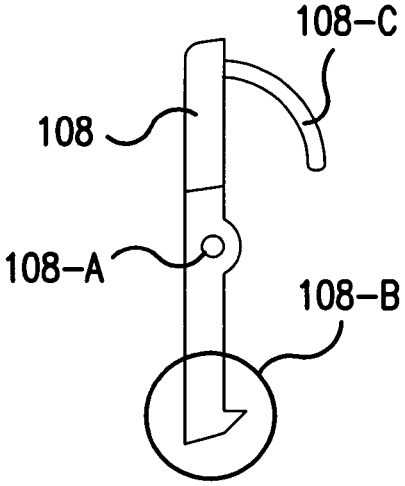
Figure 4E:
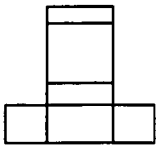

As illustrated in FIGS. 1B and 4D, the engaging member 108 may include a hook 108-B that engages with the teeth 106-B of the cap grabber 106. The engaging member 108 may be pivotally attached to the housing 102 via an axle 108-A. The engaging member 108 may further include an engaging spring 108-C that provides an engaging force so that the engaging of the cap grabber 106 and the corresponding engaging member 108 is maintained.

The operation of the bottle opener 100 is explained with reference to FIG. 1B. When it is desired to open a bottle, the bottle opener 100 may be placed such that the opening at the bottom is placed over the bottle cap. More specifically, the top of the bottle cap may make physical contact with the disk 112 and/or the upper inner portion of the plurality of cap grabbers 106.

As the bottle opener 100 is pushed down, the upward movement of the plurality of cap grabbers 106 causes an inward movement of the plurality of cap grabbers 106 to apply a grabbing force to the bottle cap when the cap grabbers 106 come into contact with the side of the bottle cap. When the bottle opener 100 cannot be pushed down further, the position of the cap grabbers 106 in the vertical position is maintained due to the engagement between the teeth 106-B and the hook 108-B to thereby maintain grabbing force applied to the bottle cap. As noted above, the bottle cap grabbing quality may be enhanced by arc shape of the inner portion of the cap grabbers 106 and malleable grips 106A with grooves.

With the grabbing force thus applied, the bottle opener 100 may simply be twisted to open the bottle. Note that after the bottle is opened, the bottle cap is kept in the housing 102, which may add to the presentation aesthetics.

The bottle cap may be released by pushing on the sides of the engaging members 108 which disengages the teeth 106-B of the cap grabbers 106 from the hook 108-B of the engaging member 108. When this occurs, the downward force of the spring 110 returns the cap grabbers 106 to their position at the bottom of the housing 102.

While the invention has been described with reference to the exemplary embodiments thereof, those skilled in the art will be able to make various modifications to the described embodiments of the invention without departing from the true spirit and scope of the invention. The terms and descriptions used herein are set forth by way of illustration only and are not meant as limitations. Those skilled in the art will recognize that these and other variations are possible within the spirit and scope of the invention as defined in the following claims and their equivalents.

What is claimed is:

1. A bottle cap opener, comprising:

a conical housing;

a plurality of cap grabbers vertically movable within the conical housing for applying a grabbing force to a bottle cap;

a spring for exerting a downward force to the plurality of cap grabbers; and a plurality of engaging members for engaging the corresponding plurality of cap grabbers to maintain the cap grabbers in a particular vertical position within the conical housing to allow a twisting force applied to be transferred to the bottle cap.

2. The bottle cap opener of claim 1, further comprising a including a handle formed on a top of the conical housing.

3. The bottle cap opener of claim 2, wherein the conical housing and the handle are integrally formed.

4. The bottle cap opener of claim 1, further comprising:

a plurality of grips each attached to an inner portion of the corresponding cap grabber.

5. The bottle cap opener of claim 4, wherein each of the plurality of grips is grooved.

6. The bottle cap opener of claim 5, wherein the grooves of the plurality of grips are substantially vertically oriented.

7. The bottle cap opener of claim 4, wherein the plurality of grips are formed from rubber.

8. The bottle cap opener of claim 1, wherein:

each cap grabbers includes a set of teeth, and each engaging member includes a hook for engaging the set of teeth of the corresponding cap grabber.

9. The bottle cap opener of claim 8, wherein the set of teeth are substantially horizontally grooved.

10. The bottle cap opener of claim 8, wherein each engaging member is pivotally attached to the housing via an axle and includes an engaging spring for providing an engaging force to the engaging member, and wherein the axle allows a releasing force to be applied by a user.

11. The bottle cap opener of claim 1, wherein the plurality of bottle caps are configured to retain the bottle cap within the conical housing until disengaged from the plurality of engaging members.

12. The bottle cap opener of claim 1, wherein the plurality of cap grabbers each includes a disk gap, the bottle cap opener further comprising a disk, wherein the disk is slideably attached to all of the plurality of cap grabbers, or the disk is fixedly attached to the disk gap of one of the plurality of cap grabbers and is slideably attached to remaining of the plurality of cap grabbers such that the spring exerts the downward force on the plurality of cap grabbers via the disk.

13. The bottle cap opener of claim 1, wherein the number of cap grabbers is two.

14. The bottle cap opener of claim 13, wherein the two cap grabbers are placed substantially directly opposite of each other.

15. A bottle cap opener, comprising:

a housing with an opening at a bottom;

a plurality of cap grabbers movable within the housing for applying a grabbing force to a bottle cap; and a plurality of engaging members for engaging the corresponding plurality of cap grabbers to maintain the cap grabbers in a particular vertical position within the housing to allow a twisting force applied to be transferred to the bottle cap.

16. The bottle cap opener of claim 15, wherein an interior of the housing is shaped to be progressively narrower from the bottom to a top.

17. The bottle cap opener of claim 16, wherein the interior of the housing is conically shaped or pyramid-like shaped.

18. The bottle cap opener of claim 16, wherein the plurality of cap grabbers are substantially vertically movable within the housing.

19. The bottle cap opener of claim 15, wherein inner portions of the plurality of cap grabbers are arc shaped.

20. The bottle cap opener of claim 19, further comprising:

a plurality of grips each attached to the inner portion of the corresponding cap grabber.

21. The bottle cap opener of claim 20, wherein each of the plurality of grips is grooved.

22. The bottle cap opener of claim 21, wherein the grooves of the plurality of grips are substantially vertically oriented.

23. The bottle cap opener of claim 20, wherein the plurality of grips are formed from malleable materials.

24. The bottle cap opener of claim 18, wherein:

each cap grabber includes a set of teeth, and each corresponding engaging member includes a hook for engaging the set of teeth of the corresponding cap grabber.

25. The bottle cap opener of claim 24, wherein each engaging member is pivotally attached to the housing via an axle and includes an engaging spring for providing an engaging force to the engaging member, and wherein the axle allows a releasing force to be applied by a user.

26. The bottle cap opener of claim 15, wherein the plurality of cap grabbers each includes a disk gap, the bottle cap opener further comprising a disk, wherein the disk is slideably attached to all of the plurality of cap grabbers, or the disk is fixedly attached to the disk gap of one of the plurality of cap grabbers and is slideably attached to remaining of the plurality of cap grabbers.

27. The bottle cap opener of claim 26, further comprising:

a spring for exerting a downward force on the plurality of cap grabbers via the disk.

* * * * *